United States Patent [19]

Morrow et al.

[11] 4,136,786

[45] Jan. 30, 1979

[54] LOGGING SYSTEM AND YARDER THEREFOR

[75] Inventors: Gary R. Morrow, Sedro-Woolley; Larry L. Dargitz, Burlington, both of Wash.

[73] Assignee: Skagit Corporation, Sedro Woolley, Wash.

[21] Appl. No.: 660,883

[22] Filed: Feb. 24, 1976

Related U.S. Application Data

[63] Continuation-in-part of Ser. No. 510,540, Sep. 30, 1974, abandoned.

[51] Int. Cl.[2] ..... B66C 21/00

[52] U.S. Cl. ..... 212/76; 212/89; 212/87; 104/112; 104/180

[58] Field of Search ..... 212/76–123, 212/72–75; 254/139, 183, 185 R, 188; 104/112, 89, 90–94, 180

[56] References Cited

U.S. PATENT DOCUMENTS

| | | | |
|---|---|---|---|
| 602,168 | 4/1898 | Palmer | 212/89 |
| 608,142 | 7/1898 | Kronfield et al. | 212/72 |
| 682,666 | 9/1901 | Brown | 212/78 |
| 773,295 | 10/1904 | Miller | 212/90 |
| 1,170,774 | 2/1916 | Morris | 212/88 |
| 1,187,698 | 6/1916 | Bailey | 212/91 |
| 2,035,107 | 3/1936 | Voss | 212/89 |
| 2,318,218 | 5/1943 | Grabinski | 212/90 |
| 3,874,517 | 4/1975 | Raven et al. | 212/89 |

FOREIGN PATENT DOCUMENTS

| | | | |
|---|---|---|---|
| 907225 | 10/1962 | United Kingdom | 212/76 |
| 1029166 | 5/1966 | United Kingdom | 212/86 |

*Primary Examiner*—Albert J. Makay
*Assistant Examiner*—R. B. Johnson
*Attorney, Agent, or Firm*—Robert C. Smith; William F. Thornton

[57] ABSTRACT

A rigging arrangement and yarder are disclosed for yarding in which a single cable is used. This cable is anchored at a main storage drum on a yarder and preferably at an anchor in the vicinity of the tail block. The single line serves as a running skyline for supporting a carriage and includes several loops around a tram drum and an idler drum (but only one layer on said drums) which operate to hold cable or to reel equal amounts of cable in or out to both the yarder side and the anchor side of the carriage to move the carriage without introducing slack into either side. Since only a single layer of cable is wound on the tram and idler drums, no energy is lost dealing with varying speeds and torques caused by changing effective diameters, thus saving energy and weight of equipment. The yarder itself is smaller and simpler because a smaller prime mover is possible, conventional auxiliary cooling equipment for slip brakes is eliminated, the tram drums are smaller than conventional mainline drums, and certain clutches, brakes and gears are eliminated. Modifications include arrangements where the idler drum is replaced with a driven drum also carrying a single layer of cable.

7 Claims, 5 Drawing Figures

LOGGING SYSTEM AND YARDER THEREFOR

CROSS REFERENCE TO RELATED APPLICATION

This application is a continuation-in-part of application Ser. No. 510,540 filed Sept. 30, 1974, now abandoned.

BACKGROUND OF THE INVENTION

In lumbering operations it becomes necessary, after trees are cut, to move the felled logs from the area where they have fallen to a location near a road where they can be loaded and carried away. One way in which this has been done is to move into the area with a tractor-like vehicle and simply drag the logs to the road. This is often an unacceptable method because of damage to the terrain and to young trees caused by the vehicle and the dragging of the logs. In many areas the terrain is too rough for such vehicles to operate successfully.

A more acceptable technique and one which has been used in many forms for years involves the use of logging systems with skylines extending from a yarder machine over many hundreds of feet to a tail block with a carriage movable back and forth on the skyline between the yarder and the tail block for transporting the logs to a road near the yarder. The yarder itself is typically a large and heavy vehicle with a prime mover of 300 to 500 horsepower or more, a tower with fairleader sheaves, various drums with cable of different sizes, and clutches and brakes for controlling the reeling of the cable or wire rope off or on the drums and through the various fairleader sheaves. A typical yarder may be capable of being set up to operate with several kinds of rigging arrangements. One such arrangement is called grapple yarding and is described in detail in U.S. Pat. No. Re. 27621 (common assignee). In this system a "running skyline" is rigged from a skyline drum through a fairleader sheave at the top of the tower out to a tail stock and back to a stationary terminal on the far side of the carriage from the yarder, the carriage having one or two sheaves riding on the skyline. A separate mainline has both ends connected to mainline drums on the yarder and passes around a sheave on the carriage. A tag line attached to one of the mainline halves passes over a load sheave on the carriage and is connected to trip a grapple which is suspended from the carriage to cause it to close to pick up a turn of logs or to open to drop the logs. Normally, the skyline is slackened to cause the grapple to lower toward the logs and is tightened to lift the load before the carriage is caused to move toward the yarder.

A somewhat similar arrangement is described in U.S. Pat. No. 3,531,000 (common assignee) but is used for operation with chokers. In this sytem, a crew in the field attaches a choker cable to a turn of logs, and the carriage is lowered by slackening the skyline so that the choker cable may be attached to the carriage or to a line suspended from the carriage. In either of these arrangements, the yarder must include the drums mentioned above, and such drums are sized differently because the skyline and mainline cables are usually of different size. Some rigging arrangements require three different sizes of cable. The cables are typically wound twelve or more layers deep on the drums which means that the effective diameters of the drums vary as they are wound and unwound with accompanying changes in forces and speeds connected with cable movement. To deal with these changes the yarder operator is required to operate various brakes and clutches which absorb substantial energy and which also require considerable operator skill. The winding of many layers of cable on the mainline drums also results in some wear on the cables due to crushing and abrasion.

IN THE DRAWINGS

DETAILED DESCRIPTION OF THE PREFERRED EMBODIMENT

Figure 1:
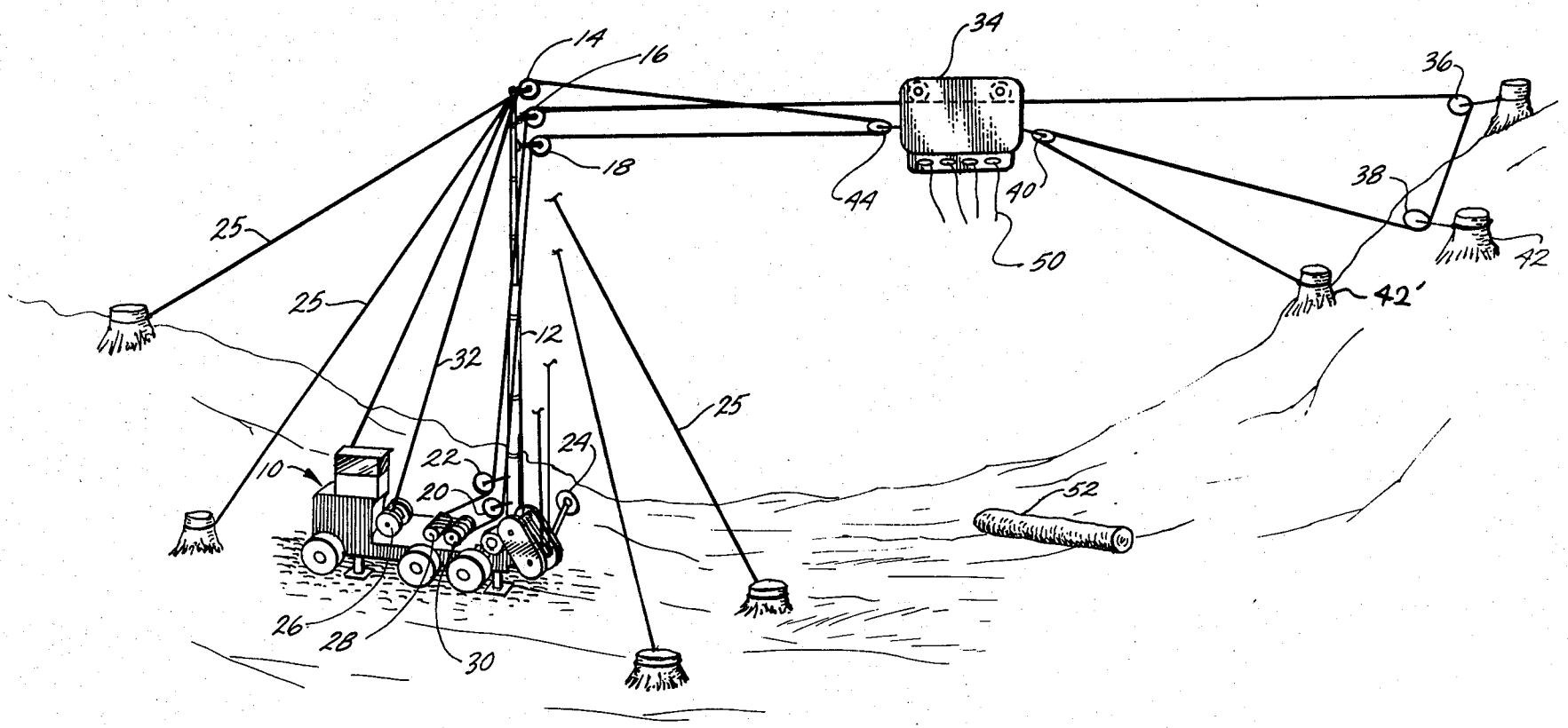
FIG. 1 is a perspective view of a yarder rigged according to our invention.

Referring now to FIG. 1, a yarder shown generally at numeral 10 carries a tower 12 to which are attached a skyline fairleader 14, an outhaul fairleader 16, and an inhaul fairleader 18. Additional pulleys or idler sheaves 20 and 22 are attached to the tower. Attached to an arm at the forward end of the yarder is a strawline sheave 24. The tower 12 is supported by a plurality of guylines 25. Carried on the frame of the yarder 10 is a storage and skyline drum 26, a separate tram or drive drum 28 and an idler drum 30. Drums 26, 28 and 30 are driven by an engine carried on the yarder and controlled as discussed below. The skyline cable 32 is anchored on the drum 26 and feeds from this drum through fairleader 14 from which it extends outwardly to a carriage 34 and back around drums 28 and 30 and outwardly to support carriage 34 and from thence through a tail block 36, a tail hold 38, back through a sheave 40 on carriage 34 to an anchor 42.

Figure 2:
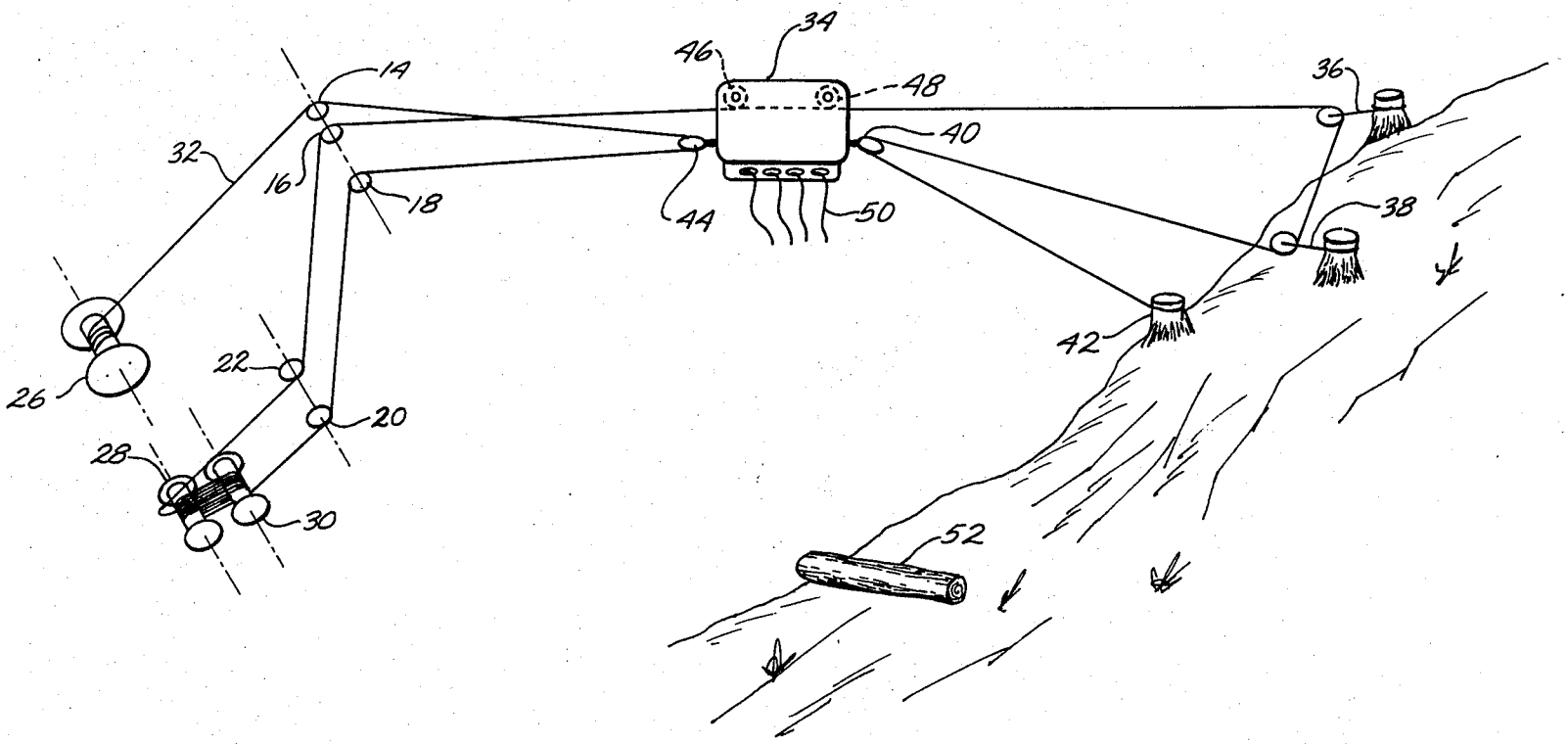
FIG. 2 is a schematic diagram showing details of the rigging arrangement of FIG. 1.

Details of this rigging arrangement may be more apparent from consideration of FIG. 2. In this schematic drawing the skyline and storage drum 26 has one end of the skyline cable 32 anchored thereto, and from this drum the cable extends outwardly through the skyline fairleader 14, outwardly and around a sheave 44 on the yarder side of the carriage 34, back around the inhaul fairleader 18, sheave 20, under the idler drum 30 to wrap several times around tram drum 28 and idler drum 30, passing around sheave 22, back up the tower to the outhaul fairleader and outwardly through the carriage 34 where it passes under a pair of sheaves 46 and 48, thereby supporting the carriage. Continuing outwardly to tail block 36, it passes around this sheave, another sheave in tail hold 38 and back toward the carriage where it passes around a sheave 40 before being dead-ended at an anchor 42'.

From following this arrangement, it is apparent that a single cable extending between the storage drum 26 and anchor 42 provides the skyline, haulback and mainline functions requiring three separate cables of different sizes in conventional rigging arrangements. A plurality of choker cables 50 are shown suspended from carriage 34, and when it is desired to lower the carriage to pick up a log 52, the skyline and storage drum 26, along with tram drum 28, is rotated to reel out cable which causes slack in the skyline, thus lowering the carriage to permit the choker cables to be attached to the log 52. A number of logs might be attached to the choker cables, if located such as to be convenient. The log can then be lifted by tightening the skyline--a reversal of the drum rotation previously described--and transported back to the vicinity of the yarder 10 by holding the storage drum 26 and rotating tram drum 28 and idler drum 30 in such direction (clockwise as shown) as to pull sheave 44 toward the yarder while at the same time cable is reeled off the top of the drum 28 to feed more cable through the carriage and sheaves 36 and 38 to allow sheave 40 to move to the left. The log can be moved downwardly by slackening the skyline as described. When the skyline is again tightened, the carriage may be moved outwardly by holding the storage drum 26 and rotating tram drum 28 and idler drum 30 counterclockwise, which reels in on that part of cable 32 upon which the carriage rides, thus pulling sheave 40 to the right. At the same time that part of the cable passing over sheaves 20 and 18 is reeling out, thus permitting sheave 44 to move toward the right.

It will be observed that the arrangement involving tram drum 28 and idler drum 30 is somewhat unconventional since line 32 is wound around both drums together. Thus they are not operated differentially as is customary with yarders. It is also conventional for the corresponding drums (usually called mainline drums) to each have one end of a mainline cable anchored thereon. In the arrangement described herein, neither of drums 28 and 30 ever contacts either end of cable 32, which ends are on drum 26 and at anchor 42. Since these drums 28 and 30 are not storage drums, they carry only one layer of cable, and so there is no problem with varying effective drum diameters with the resulting different speeds and torques. Thus the operator is relieved of a substantial problem in operating brakes and clutches to compensate for these different diameters. The energy dissipated in the conventional clutching and braking operation is not lost, and the power requirements of the system are therefore reduced. The size of the drums 28 and 30 is less than for the usual mainline drums because they only carry one layer of cable, and the usual deep flanges are eliminated. Applicants have referred to the rigging system described above as an endless cable system or a tram system because the drums 28 and 30 and the carriage 34 are always in an intermediate position along the same line. Drum 28, referred to as the tram drum, might be considered as in the nature of a capstan since it is driven, has only one layer of cable, and, in combination with idler drum 30, primarily provides a frictional holding means for cable 32.

Figure 3:
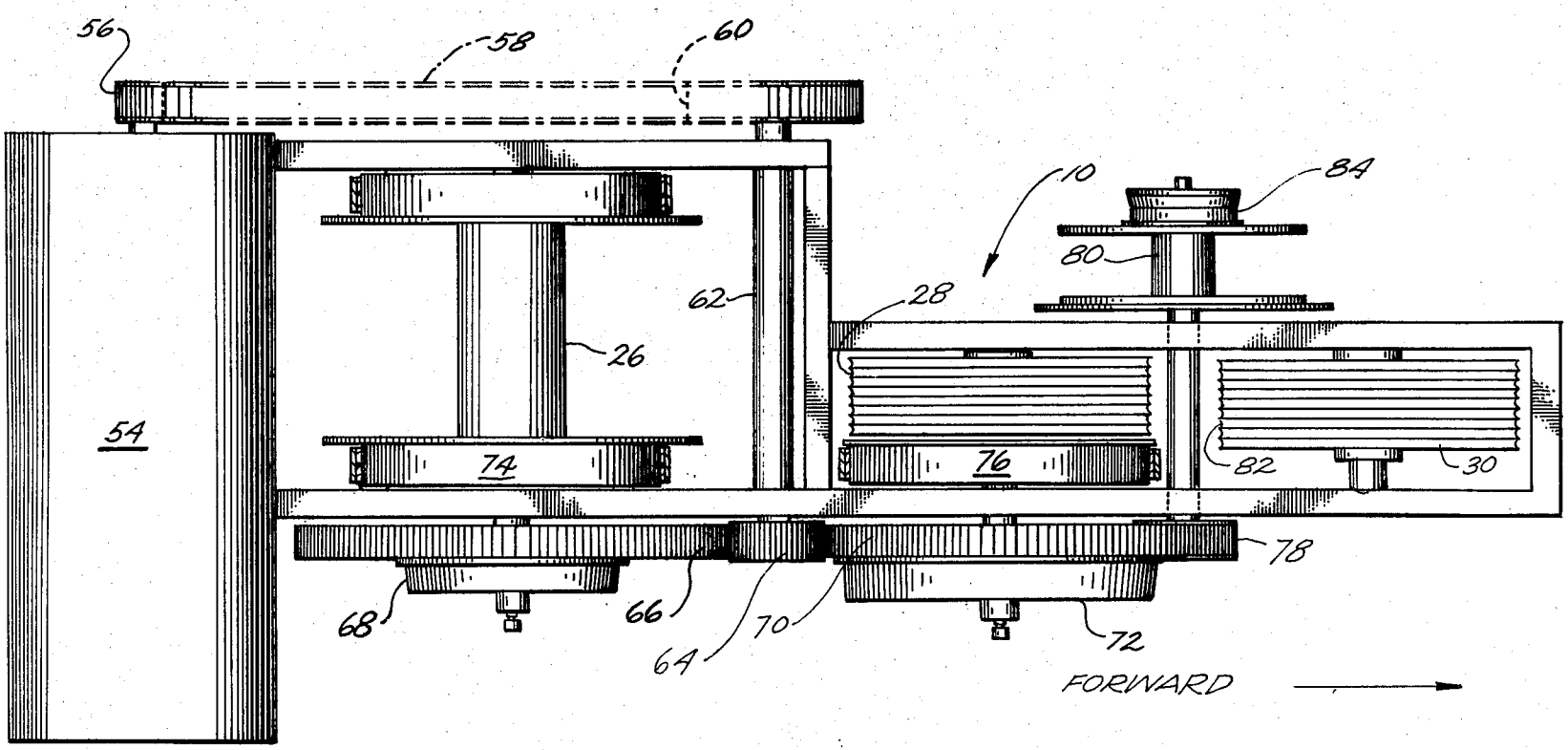
FIG. 3 is a plan view of a yarder according to our invention.

FIG. 3 is a plan view showing the arrangement of drums and driving mechanism on the yarder 10. A prime mover 54, located at the rear of the yarder (which may be a diesel engine using a transmission or hydrostatic drive), drives a sprocket 56 which, in turn, drives a cross shaft 62 having a gear 64 at its opposite end which meshes with a first gear 66 which drives the storage and skyline drum 26 through a clutch 68 and a second gear 70 which drives tram drum 28 through a clutch 72. Conventional band brakes 74 and 76, which are normally air-operated, are available for holding drums 26 and 28, respectively. Gear 70 meshes with a smaller gear 78 at the end of a cross shaft which drives a straw drum 80 through a clutch 84. Straw drum 80 carries a length of comparatively lightweight wire rope which can be handled manually and which is used for rigging in a conventional manner familiar to those skilled in the art. Idler drum 30 has an axle journaled in a frame of the yarder 10 carrying a number of grooved sheaves 82, all of which float on the axle. This permits individual sheaves to rotate slightly relative to others as needed to relieve stress in the cable as it wraps around the drum.

With the clutches and brakes shown on the drums 26 and 28, the operator may operate the skyline drum 26 and drum 28 to lower or raise the carriage, or hold drum 26 while rotating drum 28 to move the carriage along the skyline, as described above. Since there is no problem with different effective diameters with drums 28 and 30, however, there is no occasion to operate these drums differentially, and so no dealing with separate clutches and brakes on each as is done with a conventional mainline arrangement. Thus the losses in these brakes are eliminated, the cooling water therefor is eliminated, one set of clutches and brakes is eliminated entirely, and the drums become smaller because they are not storage drums. The effect of these differences is to significantly reduce the power required to drive the system, permitting use of a smaller prime mover and a somewhat smaller yarder chassis than required to do the same job with conventional equipment.

Figure 4:
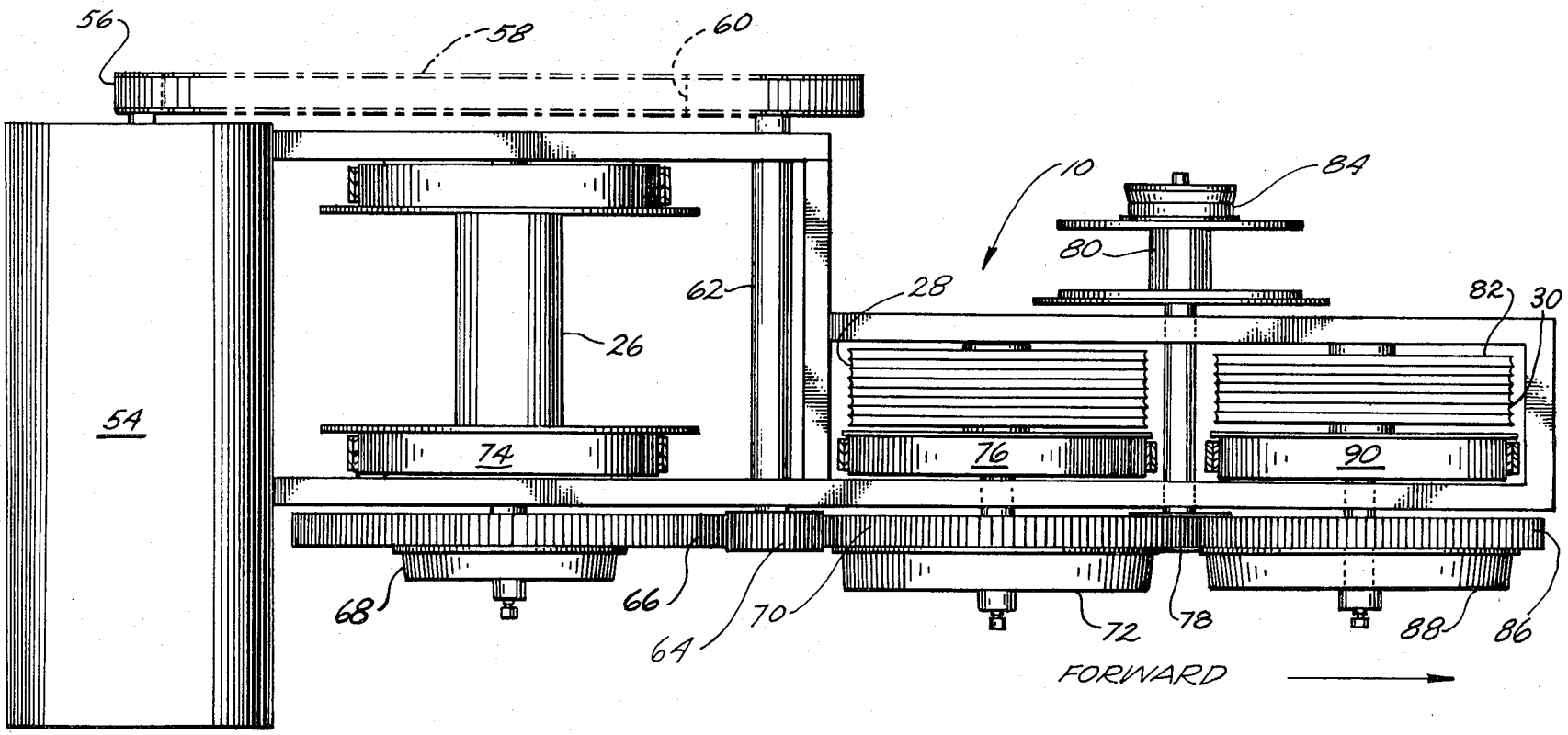
FIG. 4 is a plan view of a second embodiment of yarder according to our invention.

The embodiment shown in FIG. 4 is similar to that of FIG. 3, and identical numerals are used for corresponding parts. Operation is similar to FIG. 3 except that sheaves 82 do not float on the shaft of drum 30 but are keyed thereto and are driven by a gear 86 which is driven by gear 78. Gear 86 drives drum 30 through a clutch 88. A conventional band brake 90 is supplied for holding drum 30. With this arrangement the cable 32, which is wrapped around both of drums 28 and 30, as described, is driven by both of said drums. Since the amount of wrap of the cable subject to being driven is thereby approximately doubled, somewhat fewer turns of the cable around drums 28 and 30 are required to avoid slippage.

Figure 5:
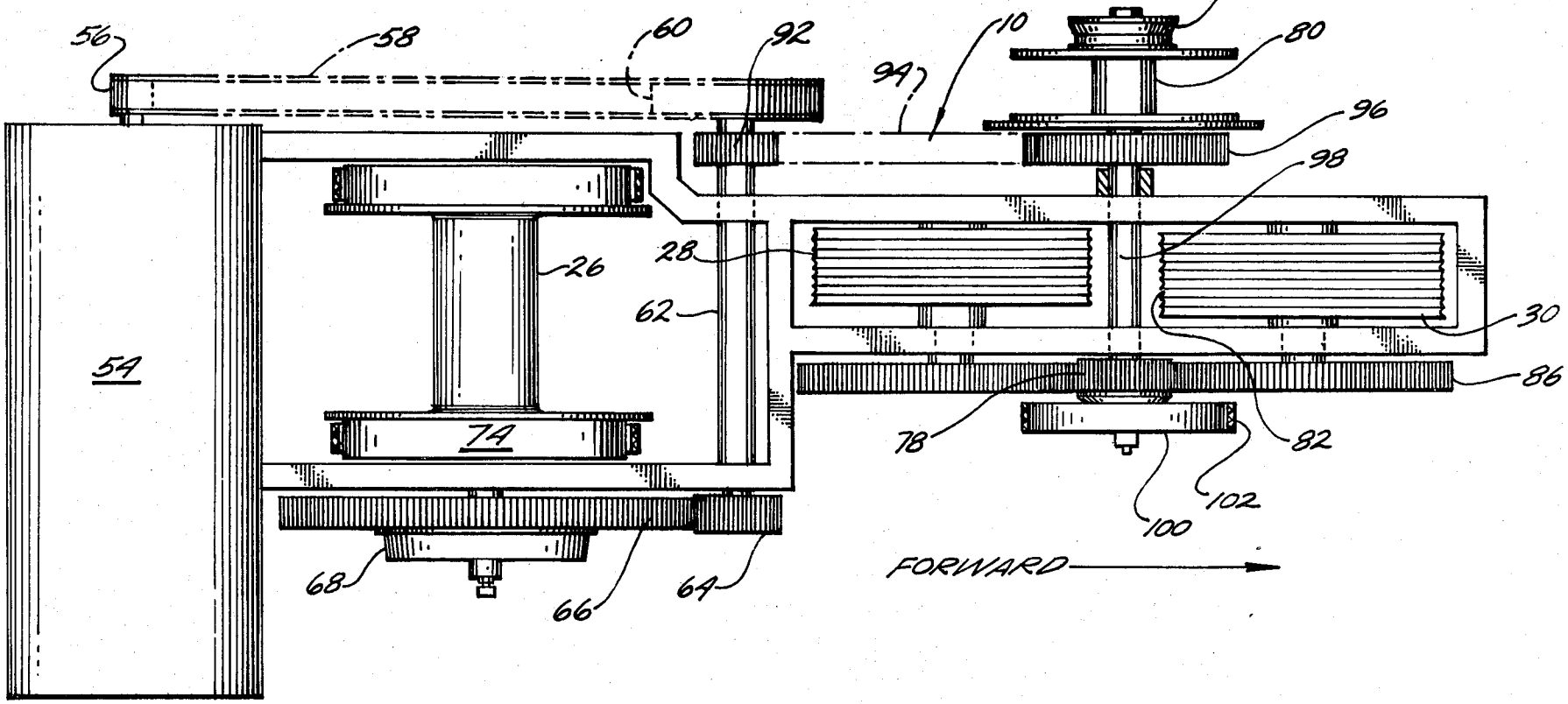
FIG. 5 is a plan view of a third embodiment of yarder according to our invention.

In FIG. 5 an embodiment is shown in which drums 28 and 30 are again driven directly and simultaneously as in FIG. 4, but wherein a single holding brake for drums 28 and 30 and a single clutch are carried on the drive shaft. This provides an operation similar to that of FIG. 4, but at some saving in components. Again similar parts have been given the same numbers. As previously described, the prime mover 54 drives an output shaft and gear 56 connected through a chain 58 to a gear 60 and one end of a cross-shaft 62. At the other end of cross-shaft 62 is a gear 64 meshed with a gear 66. Drum 26 is driven when a clutch 68 is engaged.

Also carried on cross-shaft 62 is a third gear 92 driving a chain 94 engaged with a gear 96 on one end of a second cross-shaft 98. At the opposite end of cross-shaft 98 is a gear 78 which is connected to drive both of gears 70 and 86 and drums 28 and 30 when engaged by a clutch 100. Band brakes 102 are associated with clutch 100 to hold drums 28 and 30 when desired. At the opposite end of cross-shaft 98 is positioned a straw line drum 80 which is engaged through operation of a clutch 84.

Those skilled in the art will recognize that certain modifications may be made to suit requirements. While use of both of blocks 36 and 38 helps to assure that the cable does not become fouled, operation with a single tail block is quite possible.

We claim:

1. A system for yarding logs comprising a yarder having a tower with a skyline fairleader, inhaul and outhaul fairleaders and idler sheaves, a skyline drum, first and second single layer drums and drive means connecting said skyline drum and at least one of said single layer drums, means for selectively driving said skyline drum and at least one of said single layer drums, a cable storable on said skyline drum and having one end attached thereto;

a carriage including at least one supporting sheave, a second sheave carried on the side nearer said yarder, a third sheave carried on the side farther from said yarder, and means for supporting choker cables;

a tail block;

a tail hold sheave;

and an anchor;

said cable being reeved from said skyline drum through said skyline fairleader, around said second sheave, over said inhaul fairleader and an idler sheave in a plurality of loops around both said first and second single layer drums, around a second idler sheave, said outhaul fairleader, below said supporting sheave, through said tail block and said tail hold sheave to said third sheave and having its opposite end attached to said anchor;

such that reeling cable off said skyline drum and rotating said first and second single layer drums to increase the amount of cable in said skyline and between said single layer drums and said carriage tends to lower said carriage, and reeling cable onto said skyline drum and rotating said single layer drums to decrease the amount of cable between said single layer drums and said carriage tends to raise said carriage.

2. A yarding system as set forth in claim 1 wherein holding brake means are provided operatively connected to said skyline drum and at least one of said single layer drums.

3. A yarding system as set forth in claim 2 wherein a single clutch connects both said first and second single layer drums to said prime mover.

4. A yarding system as set forth in claim 2 wherein separate clutch devices connect each of said first and second single layer drums to said prime mover.

5. A system for yarding logs as set forth in claim 1 wherein holding said skyline drum and rotating said single layer drums in first and second directions moves said carriage toward and away, respectively, from said yarder.

6. A system for yarding logs as set forth in claim 1 wherein drive gears are connected to both said first and second single layer drums and clutch means connects both said drive gears to said prime mover.

7. A system for yarding logs as set forth in claim 6 wherein drive gears are connected to both said first and second single layer drums and separate clutch means are provided for connecting both said drive gears to said prime mover.

* * * * *